US007083551B1

(12) United States Patent
Lassanske et al.

(10) Patent No.: US 7,083,551 B1
(45) Date of Patent: Aug. 1, 2006

(54) VARIABLE HEIGHT SYSTEM FOR SUPPORTING THE NON-DRIVEN WHEEL OF A BICYCLE HAVING A DRIVEN WHEEL ENGAGED WITH A BICYCLE TRAINER

(75) Inventors: Todd W. Lassanske, Madison, WI (US); Joshua G. Lohr, Watertown, WI (US)

(73) Assignee: Saris Cycling Group, Inc., Madison, WI (US)

( * ) Notice: Subject to any disclaimer, the term of this patent is extended or adjusted under 35 U.S.C. 154(b) by 325 days.

(21) Appl. No.: 10/673,942

(22) Filed: Sep. 29, 2003

(51) Int. Cl.
*A63B 69/16* (2006.01)

(52) U.S. Cl. ..... 482/61; 211/22

(58) Field of Classification Search ..... 482/57, 482/61; 211/17–24; 248/35, 346.01; 280/293; D7/610; D12/111, 114, 115, 117; D21/662–664, D21/686; D27/102, 103, 133–135
See application file for complete search history.

(56) References Cited

U.S. PATENT DOCUMENTS

| | | | | |
|---|---|---|---|---|
| 5,036,986 | A * | 8/1991 | Kral | 211/22 |
| 5,267,657 | A * | 12/1993 | McGuiness et al. | 211/22 |
| 5,749,555 | A * | 5/1998 | Albrecht | 248/346.01 |
| 5,916,067 | A * | 6/1999 | Morasse | 482/61 |
| 6,190,290 | B1 * | 2/2001 | Mackert | 482/57 |
| 6,234,088 | B1 * | 5/2001 | Bredal et al. | 108/91 |
| D479,818 | S * | 9/2003 | Gladden, III | D12/115 |
| D486,534 | S * | 2/2004 | Ueda | D21/664 |
| 2001/0050260 | A1 * | 12/2001 | Graham | 211/23 |
| 2002/0055422 | A1 * | 5/2002 | Airmet et al. | 482/61 |

* cited by examiner

*Primary Examiner*—Stephen R. Crow
*Assistant Examiner*—Tam Nguyen
(74) *Attorney, Agent, or Firm*—Boyle, Fredrickson, Newholm, Stern & Gratz, S.C.

(57) ABSTRACT

A system for supporting the non-driven wheel of a bicycle, in which the driven wheel of the bicycle is engaged with a stationary bicycle trainer. The system contemplates a support member that is configured for engagement with a supporting surface, and which includes wheel engagement structure for supporting the non-driven wheel above the supporting surface. A pair of support members are engaged together in different orientations, to raise the elevation of the wheel engagement structure of the upper support member above the supporting surface and to enable the user to adjust the angle of the bicycle.

12 Claims, 5 Drawing Sheets

VARIABLE HEIGHT SYSTEM FOR SUPPORTING THE NON-DRIVEN WHEEL OF A BICYCLE HAVING A DRIVEN WHEEL ENGAGED WITH A BICYCLE TRAINER

BACKGROUND AND SUMMARY OF THE INVENTION

This invention relates to a system for supporting the non-driven wheel of a bicycle when the driven wheel of the bicycle is engaged with an exercise device such as a bicycle trainer, and more particularly to such a system in which the height of the bicycle wheel can be varied so as to vary the angle of inclination of the bicycle.

A common form of exercise involves use of a bicycle trainer, which includes a frame that supports the driven wheel of the bicycle and a resistance unit that engages the wheel to apply resistance upon rotation of the wheel. Bicycle trainers of this type are available from Graber Products, Inc. of Madison, Wis. under its designation CYCLE-OPS, as well as from a number of other sources.

The driven wheel of the bicycle, which is typically the rear wheel, is elevated above the supporting surface, such as a floor, when supported by the frame of the bicycle trainer for engagement with the resistance unit of the trainer. This results in the bicycle being oriented at a downward angle when the non-driven wheel, typically the front wheel, rests on the supporting surface. To address this problem, it is known to support the front wheel using a riser block or the like, one example of which is illustrated in Mackert U.S. Pat. No. 6,190,290, the disclosure of which is hereby incorporated by reference. The '290 patent illustrates a riser block that has a number of upwardly facing arcuate grooves or recesses having different radii, so as to receive differently sized bicycle wheels. While this type of support functions satisfactorily, it only serves to elevate and maintain the front bicycle wheel at a predetermined elevation, which is designed so as to position the bicycle in a generally level attitude relative to the support surface.

It is a object of the present invention to provide a support system for the non-driven wheel of a bicycle having a driven wheel engaged with a bicycle trainer, which is adapted to support the wheel at a number of different elevations relative to the supporting surface to that the bicycle can be positioned in a level orientation and also at an uphill angle when the non-driven wheel is located above the driven wheel. It is a further object of the invention to provide such a system which is easy to use and can be quickly and easily adjusted so as to support the front wheel of the bicycle at different elevations. Yet another object of the invention is to provide such a system which functions in a manner similar to the prior art to provide ease of understanding and use. A still further object of the invention is to provide such a system which is relatively simple in its construction while providing a great deal of flexibility in supporting a bicycle wheel at different elevations above the supporting surface.

In accordance with one aspect of the present invention, a system for stationarily supporting the non-driven wheel of a bicycle includes first and second support members configured such that one of the support members can be used to support the bicycle wheel, or such that the support members can be used together to support the bicycle wheel at different elevations. Each support member includes a base that normally rests on the supporting surfaces and wheel engagement structure located above the supporting surface, which is configured to engage the wheel. When the first and second support members are used in combination, the support members can be engaged in different orientations relative to each other, in which a lower one of the support members is positioned between the supporting surface and an upper one of the support members.

In a first orientation, the support members are positioned in a nesting orientation, in which an upper area of the lower support member is received within an interior defined by the upper support member, and a lower portion of the lower support member is located between the supporting surface and the lower extent of the upper support member. In this manner, the wheel engagement structure of the upper support member is raised to a first elevation relative to the supporting surface that is above the elevation of the wheel engagement structure when the upper support member is placed directly on the supporting surface.

In a second orientation, the support members are arranged in a back-to-back stacked orientation, in which the lower support member is inverted and the lower extent of the upper support member engages the upper extent of the lower support member. In this orientation, substantially the entire height of the lower support member is located between the supporting surface and the upper support member, to place the wheel engagement structure of the upper support member at a second elevation above the first elevation.

In a third orientation, the upper and lower support members are positioned so that both the upper and lower support members face upwardly and are engaged in a non-nesting stacked configuration, to place the wheel support structure of the upper support member at a third elevation above the first elevation and below the second elevation. The lower support member includes upwardly facing support structure, which is configured to engage the upper support member when the upper support member is positioned out of alignment with the lower support member.

In a preferred embodiment, the first and second support members are generally identical in construction, so that either of the support members may be used as the upper support member and either support member may be used as the lower support member. The support members have a series of interconnected walls that form a base and define a hollow interior. The wheel engagement structure may be in the form of a number of arcuate recesses or troughs located at different elevations relative to the base. In the nesting orientation, the wheel engagement structure of the lower support member nests within a matching interior defined by the wheel engagement structure of the upper support member. In the back-to-back stacked configuration, the lower support member is inverted so that the upper extent of the wheel engagement structure engages the supporting surface and the base of the lower support member faces upwardly. The bases of the upper and lower support members have engagement structure which prevents lateral movement between the upper and lower support members when the base of the upper support member is engaged with the upwardly facing base of the lower support member.

The arcuate recesses or troughs that make up the wheel engagement structure are each preferably defined by a pair of spaced apart walls. The support structure, which is operable to position the first and second support members in the third orientation, is preferably in the form of transversely aligned recesses in the walls that define the wheel engagement structure, each of which terminates in an upwardly facing lower land that is cofigured to engage the lower extent of one of the walls defining the base of the upper support member.

The invention contemplates a system for supporting the non-driven wheel of a bicycle at different elevations, as summarized above, as well as a method of supporting a bicycle wheel at different elevations and a support member that is capable of being used to support a bicycle wheel at different elevations, substantially in accordance with the foregoing summary.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF THE INVENTION

Figure 1:
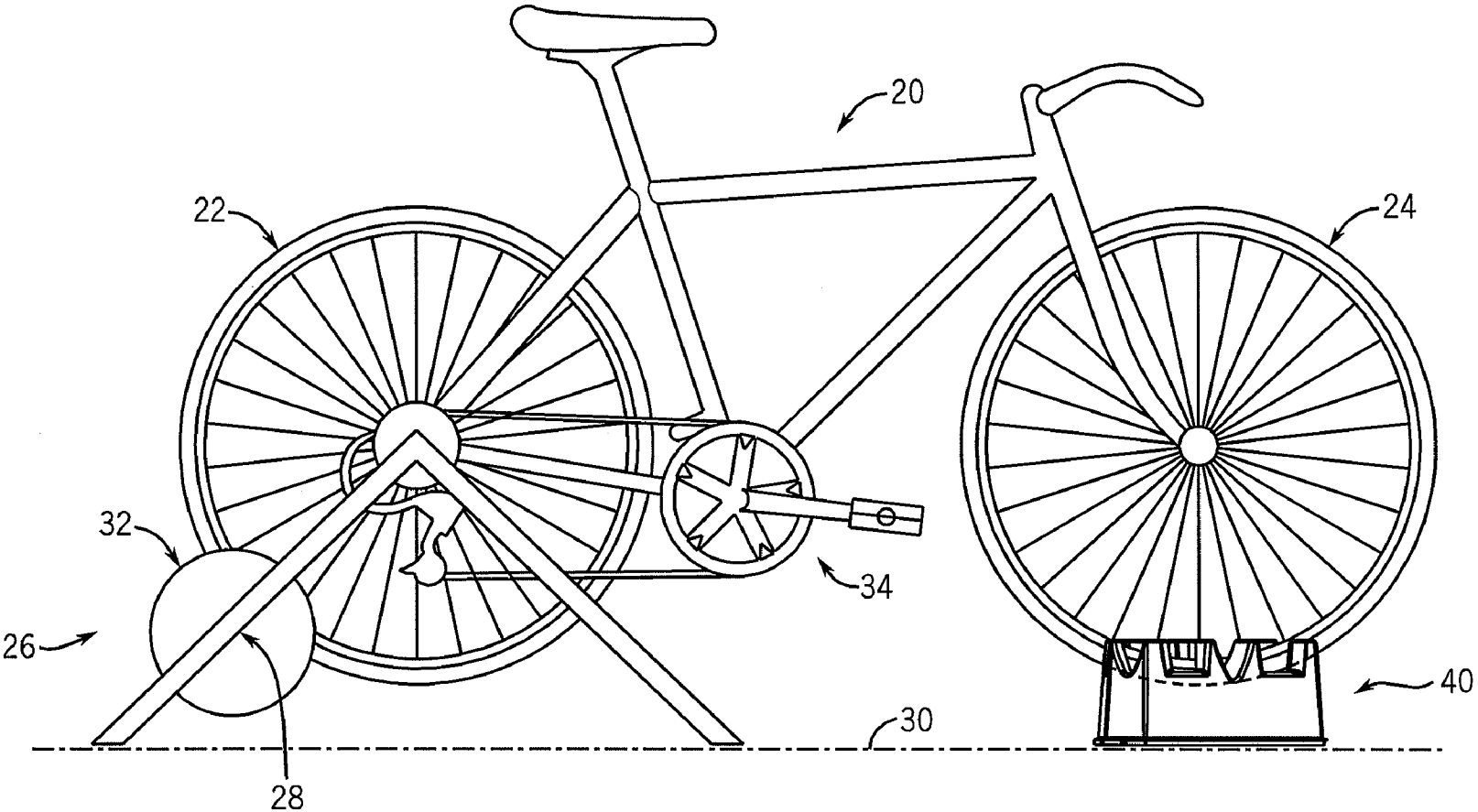
FIG. 1 is an elevation view illustrating a bicycle engaged with an exercise device such as a bicycle trainer, and in which the front or non-driven wheel of the bicycle is supported using a support member constructed in accordance with the present invention.

FIG. 1 illustrates a bicycle 20 which includes a driven rear wheel 22 and a non-driven front wheel 24. In a known manner, bicycle 20 is engaged with a stationary bicycle trainer 26, which includes a frame 28 that engages the hub of driven wheel 22 for supporting driven wheel 22 above a supporting surface 30, such as a floor. Bicycle trainer 26 includes a resistance unit 32 that engages rear wheel 22, for applying resistance to rotation of rear wheel 22 upon operation of bicycle 20 using the bicycle pedal assembly, shown at 34. Trainer 26 may be of any conventional construction and configuration, such as is available from the Cycle-Ops Division of Graber Products, Inc. of Madison, Wis. Resistance unit 32 may have any type of known resistance mechanism, such as wind, magnetic, fluid, electronic, etc.

Front wheel 24 of bicycle 20 is engaged with a support member 40, which rests on supporting surface 30 and engages the lower extent of front wheel 24. Support member 40 is configured to raise front wheel 24 above supporting surface 30 when rear wheel 22 of bicycle 20 is engaged with frame 28 of bicycle trainer 26. In a representative embodiment, support member 40 is configured to raise front wheel 24 to an elevation similar to that of rear wheel 22, so that bicycle 20 has a generally level attitude during operation.

Figure 2:
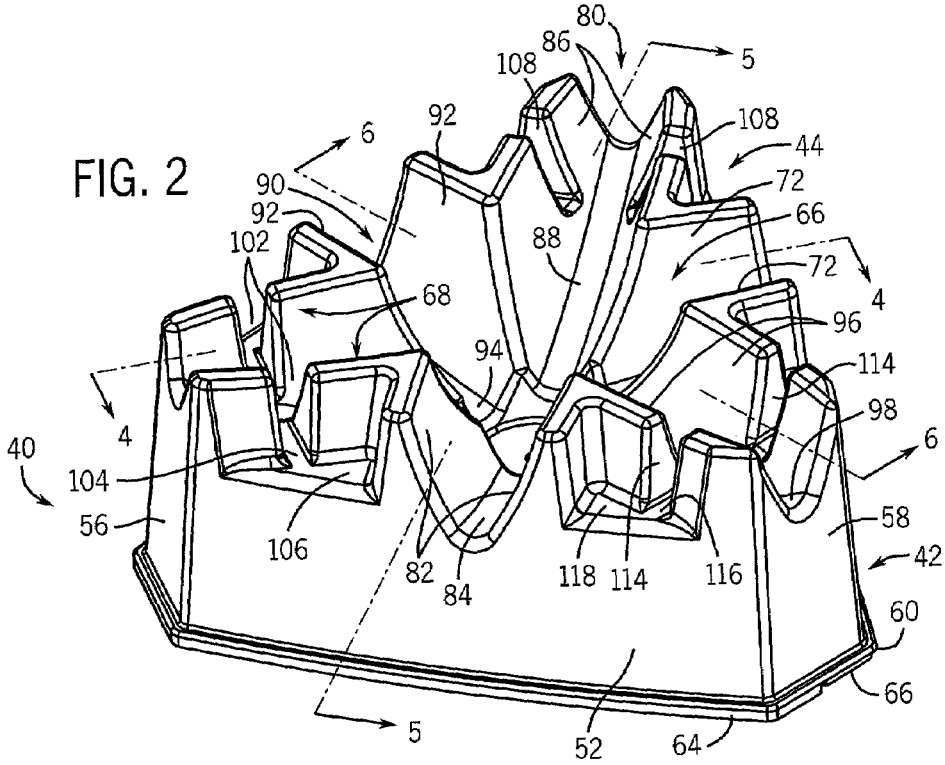
FIG. 2 is an isometric view of the support member shown in FIG. 1.
Figure 3:
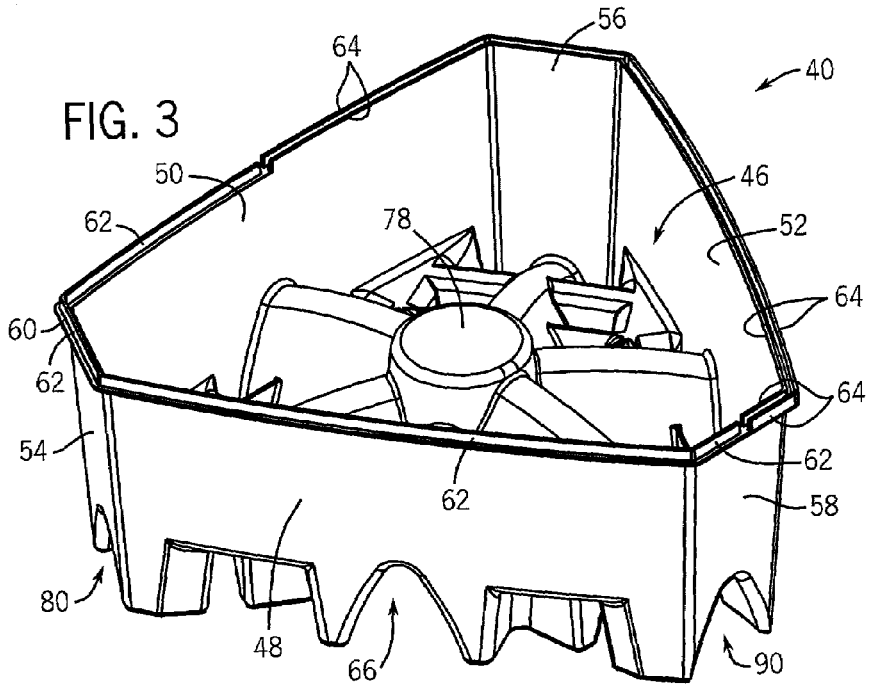
FIG. 3 is an isometric view illustrating the support member of FIGS. 1 and 2 in an inverted position.

The construction of support member 40 is illustrated in FIGS. 2–6. Generally, support member 40 includes a lower base section 42 and an upper wheel engagement section 44. Base section 42 and wheel engagement section 44 cooperate to define a generally hollow interior 46, as shown in FIG. 3, which is open at the bottom of base section 42 and closed at the top by the structure of wheel engagement section 44.

Support member 40 has a generally triangular configuration, defined by a series of base side walls shown at 48, 50 and 52. The corners of the triangular shape of base section 42 are truncated, and are defined by an end wall 54 located between side walls 48 and 50, an end wall 56 located between side walls 50 and 52, and an end wall 58 located between side walls 48 and 52.

A transverse base lower edge 60 extends about the periphery of base section 42, and is located at the lowermost extent of base side walls 48, 50, 52 and base end walls 54, 56, 58. Transverse lower edge 60 has a centrally oriented single rib 62 that extends throughout the length of side wall 48 and end wall 54, and throughout half the length of base side wall 50 and base end wall 58. A double rib 64 extends from base lower edge 60 throughout the length of base side wall 52 and end wall 56, and throughout half the length of base side wall 50 and base end wall 58. Double ribs 64 cooperate with lower edge 60 to define a channel construction, with the space between double ribs 64 being slightly greater than the width of single rib 62. Single rib 62 and double ribs 64 extend generally the same distance from lower edge 60. With this construction, it can be appreciated that single rib 62 occupies half the circumference of the lower edge of base section 42, and double ribs 64 occupy the remaining half of the circumference of the lower edge of base section 42.

Figure 4:
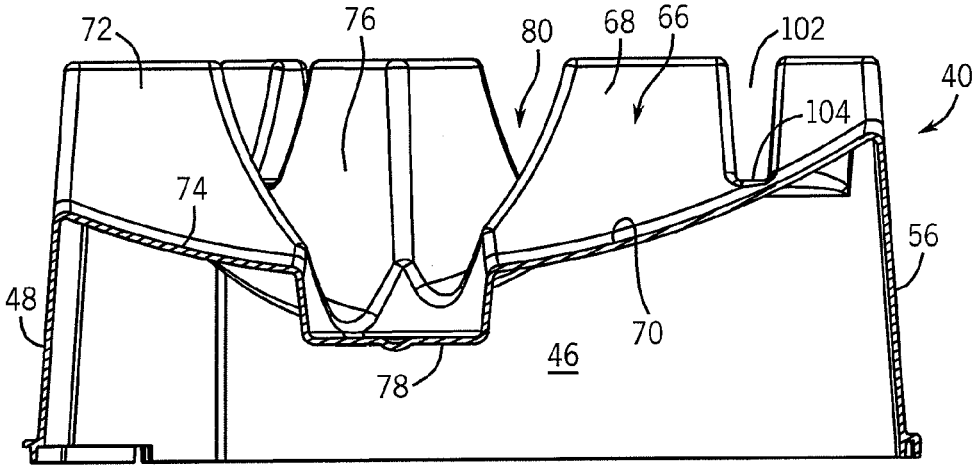
FIG. 4 is a section view taken along line 4—4 of FIG. 2.

Wheel engagement section 44 of support member 40 has a series of upwardly facing arcuate troughs or recesses that are configured to receive and support the front wheel, such as 24, of a bicycle that is engaged with bicycle trainer 26. Referring to FIGS. 2 and 4, a first upwardly facing recess 66 is defined by a pair of recess side walls 68 and an arcuate bottom wall 70, in combination with a pair of aligned side walls 72 and an aligned arcuate bottom wall 74. An open central area 76 is located between side walls 68 and 72 and between bottom walls 70 and 74, and is closed at its lower end by a bottom wall 78. Recess 66 opens onto end wall 56 and side wall 48, and bottom walls 70 and 74 have a curvature that is configured to match the radius of the largest size of non-driven bicycle wheel 24, such as that found on a road racing bicycle. In this manner, bicycle wheels of smaller diameter can also be received within recess 66. In addition, the width of recess 66, as defined by side walls 68 and 72, is selected so as to enable bicycle tires and wheels of different widths to be received within recess 66. For a relatively wide bicycle tire, such as that used in a mountain bike or the like, the sides of the tire may engage side walls 68 without engaging bottom walls 70 and 74.

Figure 5:
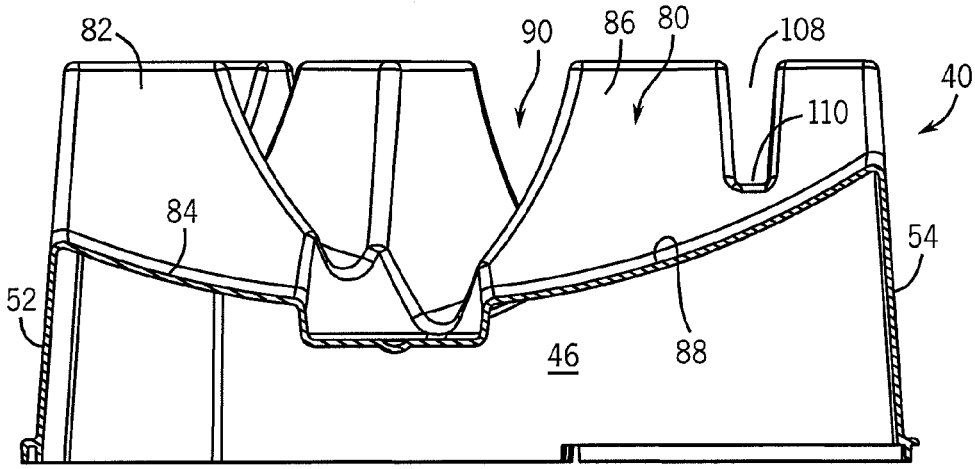
FIG. 5 is a section view taken along line 5—5 of FIG. 2.
Figure 6:
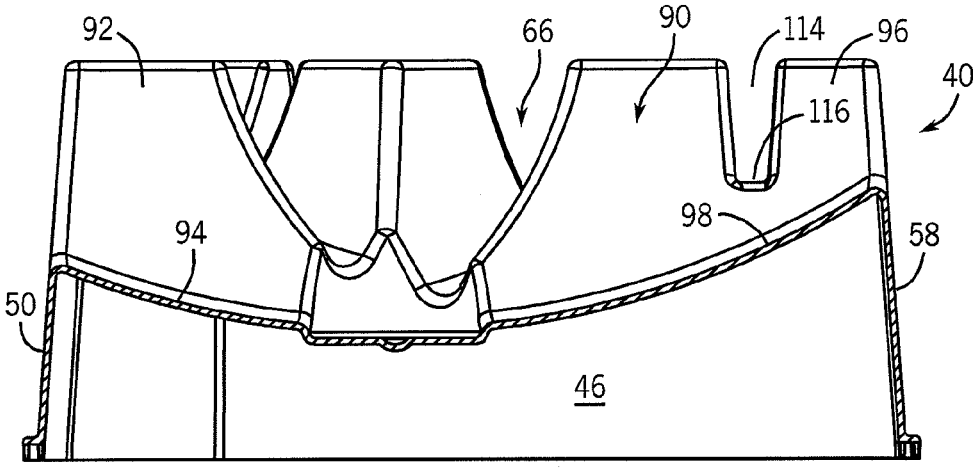
FIG. 6 is a section view taken along line 6—6 of FIG. 2.

In a similar manner, wheel engagement section 44 of support member 40 includes a second upwardly facing recess 80 as shown in FIGS. 2 and 5, which is defined by spaced apart recess side walls 82 and a bottom wall 84 located on one side of open central area 76, and spaced apart side walls 86 and a bottom wall 88 located on the opposite side of open central area 76. Recess 80 has a configuration similar to that of recess 66, although bottom walls 84 and 88 are located at an elevation below that of bottom walls 70 and 74 of recess 66. Similarly, with reference to FIGS. 2 and 6, wheel engagement section 44 of base section 42 further includes a third recess 90 defined by spaced apart side walls 92 and an arcuate bottom wall 94 located on one side of open central area 76, and a pair of spaced apart side walls 96 and an arcuate bottom wall 98 located on the opposite side of open central area 76. Recess 90 has a configuration similar to that of recesses 66 and 80, although bottom walls 94 and 98 of recess 90 are located at an elevation below that of bottom walls 84 and 88 of recess 80 and bottom walls 70 and 74 of recess 66.

With the arrangement as described above, the user can vary the elevation of front wheel 24 by engaging front wheel 24 within a selected one of recesses 66, 80 or 90, as desired.

As shown in FIGS. 2 and 4, each recess side wall 68 includes a transverse gap 102 that terminates in an upwardly facing land 104. Gap 102 extends between recess 66 and an external recess that defines an upwardly facing shoulder 106 located at the same elevation as land 104. Similarly, side walls 86 of recess 80 are formed with transverse gaps 108 that terminate in upwardly facing lands 110, which are in alignment with shoulders 112 defined by external recesses located adjacent sidewalls 86. Side walls 96 of recess 90 are formed with gaps 114 that terminate in upwardly facing lands 116, which are in alignment with shoulders 118 defined by external recesses located adjacent side walls 96. Lands 104, 110, 116 and shoulders 106, 112, 118 are all located at the same elevation relative to the lowermost extent of base section 42.

Figure 7:
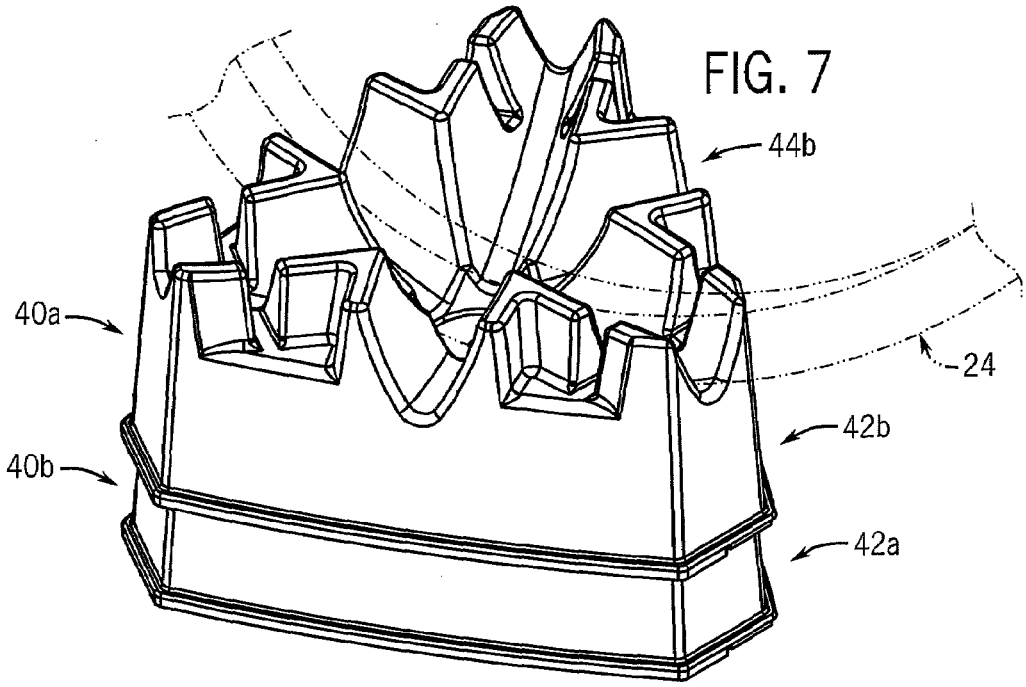
FIG. 7 is an isometric view illustrating a pair of support members in a first, nested, stacked orientation for elevating the wheel support structure of the upper support member.
Figure 8:
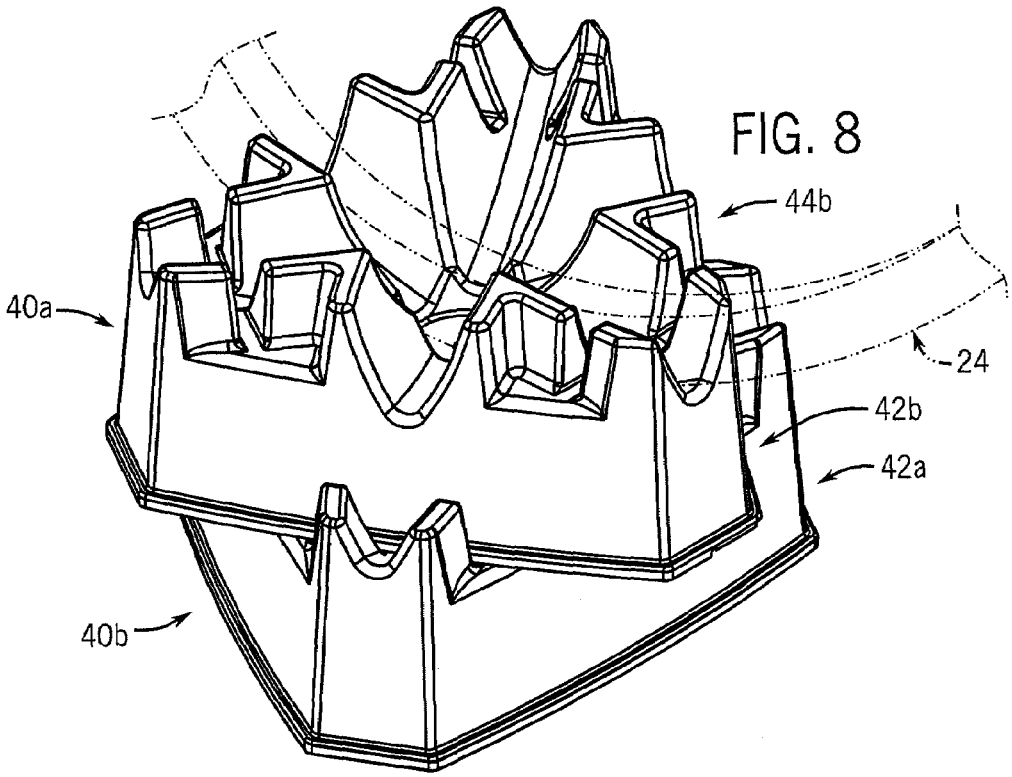
FIG. 8 is an isometric view illustrating a pair of support members in a non-nested, stacked orientation for elevating the wheel support structure of the upper support member to a different elevation.
Figure 9:
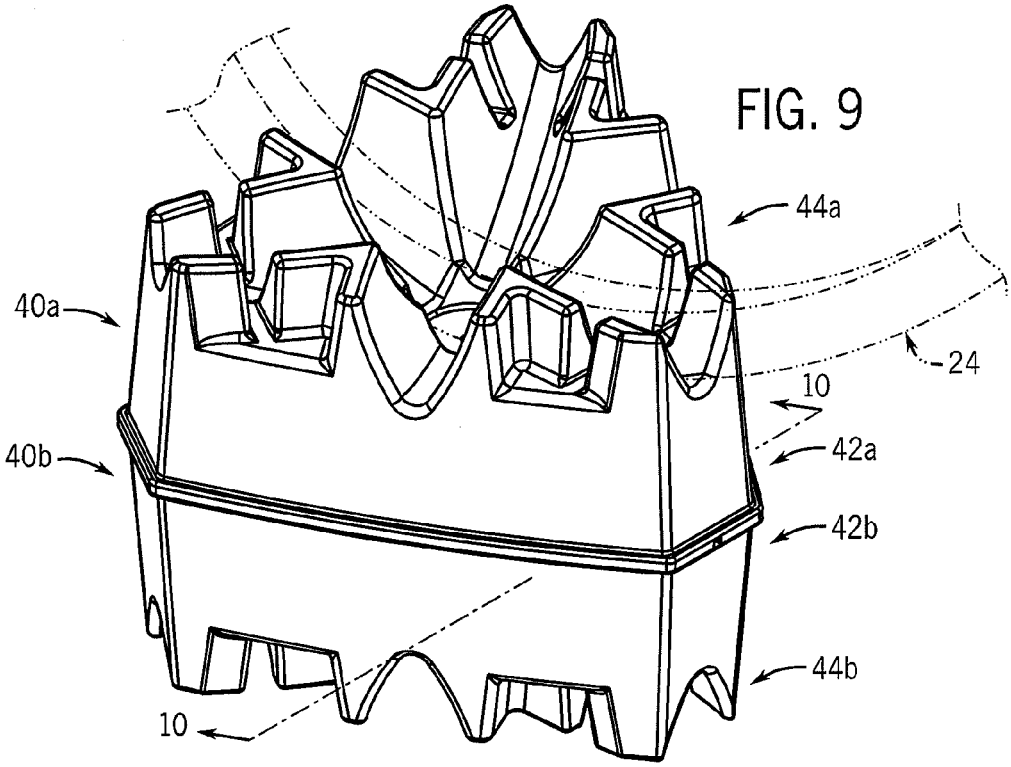
FIG. 9 is an isometric view illustrating a pair of support members in a back-to-back stacked orientation, for elevating the wheel support structure of the upper support member to a different elevation.

As noted previously, the height of bicycle front wheel 24 can be adjusted using a single support member 40 by positioning the bicycle wheel 24 within a selected one of recesses 66, 80 and 90. In addition, the height of bicycle wheel 24 can further be adjusted by employing a pair of support members engaged together in different orientations or configurations, such as is illustrated in FIGS. 7–9. In FIGS. 7–9, a pair of support members 40 are employed, with the upper support member being designated 40*a* and the lower support member being designated 40*b*. For the remainder of this description, the designation "a" will be used to denote areas and features associated with upper support member 40*a*, and the designation "b" will be used to denote areas and features associated with lower support member 40*b*.

FIG. 7 illustrates support members 40*a* and 40*b* in a nested orientation, in which upper support member 40*a* and lower support member 40*b* both face upwardly and are stacked in a nesting relationship. In this configuration, wheel engagement area 44*b* of lower support member 40*b* is received within interior 46*a* of upper support member 40*a*. Recesses 66*a*, 80*a* and 90*a* may be positioned in vertical alignment with recesses 66*b*, 80*b* and 90*b*, respectively, to nest support members 40*a* and 40*b* together. It is understood, however, that support members 40*a* and 40*b* may be configured to nest together when the various recesses of upper support member 40*a* and lower support member 40*b* are positioned out of alignment. The various side walls and end walls of base sections 42*a* and 42*b* are convergent in an upward direction, to enable the upper extent of lower support member 40*b* to be received within interior 46*a* of upper support member 40*a*. When upper support member 40 and lower support member 40*b* are stacked together in a nesting relationship as shown in FIG. 7, the user can position front bicycle wheel 24 in any desired one of recesses 66*a*, 80*a* or 90*a* of upper support member 40*a*, to vary the height of the bicycle wheel 24. In this configuration, the exposed portion of lower support member 40*b* that is located between supporting surface 30 and the lower extent of upper support member 40*a* functions to raise the elevation of recesses 66*a*, 80*a* and 90*a* of upper support member 40*a* above that which results when upper support member 40*a* is placed directly on supporting surface 30. In this manner, the user can support bicycle wheel 24 at a series of different elevations above supporting surface 30.

To enable the user to further raise the elevation of front bicycle wheel 24 above supporting surface 30, upper support member 40*a* and lower support member 40*b* are positioned in a non-nesting, stacked orientation as shown in FIG. 8. In this orientation, upper and lower support member 40*a*, 40*b*, respectively, are positioned to face upwardly and upper support member 40*a* is oriented so as to be out of alignment with lower support member 40*b*, in contrast to the nested orientation as shown in FIG. 7. Base side walls 48, 50 and 52 are positioned within gaps 102, 108 and 114, and engage respective lands 104, 110 and 116. Gaps 102, 108 and 114 have a width sufficient to receive base side walls 48, 50 and 52, and cooperate with respective shoulders 106, 112 and 118 to support upper support member 40*a* at an elevation above that which results when upper support member 40*a* and lower support member 40*b* are nested together as shown in FIG. 7. Again, the user is able to place bicycle wheel 24 in any one of recesses 66*a*, 80*a* and 90*a*, to provide further adjustment of the bicycle wheel height when upper support member 40*a* and lower support member 40*b* are engaged in the non-nesting stacked configuration of FIG. 8.

Figure 10:
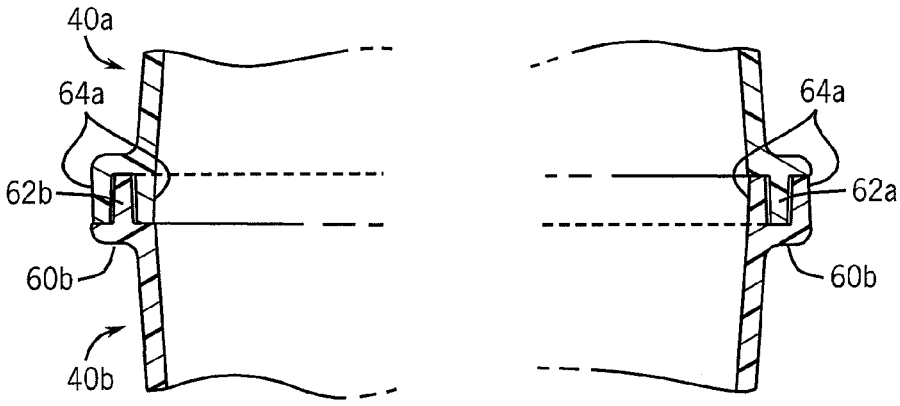
FIG. 10 is a partial section view taken along line 10—10 of FIG. 9.

FIG. 9 illustrates an orientation of upper support member 40*a* and lower support member 40*b* in which support members 40*a*, 40*b* are in a back-to-back stacked configuration. In this configuration, lower support member 40*b* is inverted so that its base section 42*a* faces upwardly and its wheel engagement section 44*a* faces downwardly. The various upper surfaces of wheel engagement section 44*b*, which include recess side walls 68*b*, 72*b*, 82*b*, 86*b*, 92*b* and 96*b*, define coplanar flat upper ends that are operable to position lower support member 40*b* in a horizontal attitude on supporting surface 30, and are configured to provide a stable support for the inverted base section 42*b* of lower support member 40*b*. As shown in FIG. 10, upper support member 40*a* is positioned relative to lower support member 40*b* so that the downwardly facing single rib 62*a* at the lower extent of upper support member 40*a* is received within the space defined between the upwardly facing double ribs 64*b* of lower support member 40*b*. Similarly, the downwardly facing double ribs 64*a* of upper support member 40*a* are positioned so that the upwardly facing single rib 62*b* of lower support member 40*b* is received within the space between double ribs 64*a* of upper support member 40*a*. In this manner, ribs 62*a*, 62*b* and 64*a*, 64*b* function to prevent lateral movement between upper support member 40*a* and lower support member 40*b*, and securely maintain upper support member 40*a* and lower support member 40*b* in engagement with each other. When upper support member 40*a* and lower support member 40*b* are in this configuration, the full height of lower support member 40*b* is located between supporting surface 30 and upper support member 40*a*, to position upper support member 40*a* at a third elevation, greater than that which results from the orientations of FIGS. 7 and 8. In addition, as before, the user can engage bicycle wheel 24 within any one of recesses 66*a*, 80*a* or 90*a* of upper support member 40*a*, to provide further adjustment of the elevation of bicycle wheel 24.

It can thus be appreciated that the upper and lower support members 40*a*, 40*b*, respectively, each define a configuration which can be generally described as a series of lobes that extend radially outwardly from a center. When the upper and lower support members are placed in the nesting orientation of FIG. 7 and the back-to-back stacked orientation of FIG. 9, the lobes of the upper and lower support members are positioned in alignment with each other. In contrast, when the upper and lower support members are placed in the non-nesting stacked orientation of FIG. 8, the upper support member is angularly offset relative to the lower support member, such that the lobes of the upper support member are located between the lobes of the lower support member.

The ability to raise the front end of bicycle 20 using the stacked support members of the present invention, allows the user to place bicycle 20 at a variety of different angular positions in which the front of bicycle 20 is elevated relative to the rear of bicycle 20. In this manner, the user is able to exercise different muscles when operating bicycle 20 in engagement with bicycle trainer 26, to vary the types of workouts that can be accomplished using bicycle trainer 26.

While the invention has been shown and described with respect to a certain embodiment, it is understood that various alternatives and modifications are contemplated as being with the scope of the present invention. For example, and without limitation, while the invention has been shown and described with respect to utilizing two identically constructed support members for positioning an upper support member at different elevations above a supporting surface, it is also understood that the lower support member may have a different configuration than that of the upper support member, with the upper and lower support members being configured to enable the upper support member to be engaged with the lower support member in varying orientations that place the wheel engagement structure of the upper support member at different elevations. In addition, while the invention has been described with respect to the upper support member being capable of supporting the wheel at different elevations, it is also understood that the upper support member may be configured to provide support at a single elevation, with variations in the elevation being accomplished simply by positioning the lower support member between the supporting surface and the upper support member. Further, it is also contemplated that the specific configuration of the support member may vary from that shown and described. For example, a possible alternative embodiment entails a central connection area in which support areas of different height radiate outwardly from the central connection area. In this construction, two identically configured support members can be engaged together in a nesting orientation, a vertically offset stacked orientation, and a back-to-back stacked orientation as shown and described, for adjusting the height of the wheel engagement areas of the upper support member. In addition, while the invention has been shown and described with respect to the upper and lower support members being engageable in three different orientations to adjust the elevation of the wheel engagement structure of the upper support member, it is also contemplated that the upper and lower support members may be engageable together in any number of different orientations so as to provide adjustment in the height of the upper support member. For example, the upper and lower support members may be configured to engage each other in a nested orientation and in a back-to-back stacked orientation, without the provision of an offset stacked orientation as shown in FIG. 8. Or, the upper and lower support members may be configured to engage each other in a nested configuration and in an offset stacked orientation as in FIG. 8, without the provision of a back-to-back stacked orientation as in FIG. 9. Further, the upper and lower support members may be engageable in an offset stacked orientation as in FIG. 8 and in a back-to-back stacked orientation as in FIG. 9, without the provision of a nested orientation as in FIG. 7. Any number of different stacking combinations and configurations are possible, and the invention is not limited to the specific combinations as shown and described. Further, it is also contemplated that different intermediate stacked configurations may be provided for attaining different heights between the nested orientation of FIG. 7 and the back-to-back stacked orientation of FIG. 9, to provide further adjustment in the elevation of the wheel engagement structure of the upper support member. In addition, while the wheel engagement structure of the support members has been shown and described as being in the form of upwardly facing recesses or troughs that are configured to receive the bicycle wheel, it is also contemplated that the wheel engagement structure of the support member may be in any other form that securely engages and retains the bicycle wheel in position relative to the support member.

Various alternatives and embodiments are contemplated as being within the scope of the following claims particularly pointing out and distinctly claiming the subject matter regarded as the invention.

We claim:

1. A system for stationarily supporting a non-driven wheel of a bicycle, wherein the bicycle includes a driven wheel engaged with a bicycle trainer, the system comprising first and second support members, wherein the first support member includes wheel engagement structure defining at least one recess configured to receive a bicycle wheel, wherein the first support member is configured to rest on a support surface for positioning the wheel engagement structure at a first elevation, and wherein the first support member and the second support member are configured for engagement together in a first orientation and a second orientation different than the first orientation, wherein the second support member is located between the support surface and the first support member in both the first and second orientations, and wherein the first and second support members in the first orientation are operable to position the recess of the first support member at a second elevation above the first elevation, and wherein the first and second support members in the second orientation are operable to position the recess of the first support member at a third elevation above the second elevation.

2. The system of claim 1, wherein the first and second support members are identically constructed, so that the second support member can be positioned between the support surface and the first support member or the first support member can be positioned between the support surface and the second support member.

3. The system of claim 2, wherein the first and second support members are further configured to engage each other in a third orientation different than the first and second orientations, wherein engagement of the first and second support members in the third orientation is operable to position the recess of the first support member at a fourth elevation different than the first, second and third elevations.

4. The system of claim 3, wherein the first orientation comprises a nesting orientation in which a lower one of the support members is received within an interior defined by an upper one of the support members, wherein the first and second support members are both positioned so as to face upwardly relative to the support surface, and wherein the second orientation comprises a non-nesting stacked orientation in which both the first and second support members face upwardly relative to the support surface and an upper one of the support members is positioned in a non-nesting relationship relative to a lower one of the support members and is engaged with upwardly facing support structure defined by the lower one of the support members, and wherein the third orientation comprises a back-to-back stacked orientation, in which a lower one of the support members faces downwardly and an upper one of the support members rests on a base defined by the lower one of the support members.

5. The system of claim 4, wherein the first and second support members are in alignment with each other when in the nesting orientation and in the back-to-back stacked orientation, and wherein the upper support member is positioned out of alignment with the lower support member when the first and second support members are in the non-nesting stacked orientation.

6. The system of claim 5, wherein the first and second support members define a series of lobes, wherein the lobes of the first and second support members are in alignment when the first and second support members are in the nesting orientation and in the back-to-back stacked orientation, and wherein the lobes of the upper support member are located between the lobes of the lower support member when the first and second support members are positioned in the non-nesting stacked orientation.

7. The system of claim 6, wherein each of the first and second support members includes a base defined by a series of walls, and wherein the base walls of the upper support member are received within upwardly facing recesses defined by the lower support member when the first and second support members are in the non-nesting stacked orientation.

8. A support arrangement for use in stationarily supporting a non-driven wheel of a bicycle wherein the bicycle includes a driven wheel engaged with a bicycle trainer, the support arrangement comprising:

a first support member having a base configured to rest on a supporting surface and a bicycle wheel engagement structure defining at least one recess for receiving a bicycle wheel located above the base such that the first support member is adapted for use by placing the base on the supporting surface so that the bicycle wheel engagement structure is located at a first elevation above the supporting surface; and a second support member, having a similar configuration, that includes a base and a bicycle wheel engagement structure defining at least one recess for receiving a bicycle wheel located above the base;

wherein the second support member is positioned between the supporting surface and the first support member for positioning the wheel engagement structure of the first support member at a second elevation, greater than the first elevation, above the supporting surface; and the first and second support members are configured to securely engage each other in a plurality of different support configurations in which the second support member is located between the supporting surface and the first support member such that each of the configurations is operable to position the wheel engagement structure of the first support member at different elevations, relative to the supporting surface.

9. The support arrangement of claim 8, wherein the base of each support member defines a hollow interior, and wherein the first and second support members are configured such that an upper portion of the second support member is received within a hollow interior of the base of the first support member in a nesting configuration, so as to place the wheel engagement structure of the first support member at an elevation above the first elevation.

10. The support arrangement of claim 8, wherein the second support member is adapted to be inverted so that the wheel engagement structure of the second support member rests on the supporting surface and the base of the second support member faces upwardly, and wherein the base of the first support member is adapted to engage and rest on the base of the second support member so as to position the wheel engagement structure of the first support member at an elevation above the first elevation.

11. The support arrangement of claim 8, wherein each of the support members further comprise non-nesting stacking support structure, and the non-nesting stacking support structure of the second support member engages the base of the first support member when the base of the second support member is placed on the supporting surface and the first support member is positioned out of alignment on the second support member, to place the wheel engagement structure of the first-mentioned support member at an elevation above the first elevation.

12. The support arrangement of claim 11, wherein the wheel engagement structure of the first and second support members comprise a series of recesses that are defined by spaced apart walls, wherein the spaced apart walls that define the recesses include a base engagement area so that the base of the first support member is engaged within the base engagement areas of the spaced apart walls of second support member when the first support member is positioned out of alignment on the second support member.

* * * * *